US007766318B2

(12) United States Patent
Krause et al.

(10) Patent No.: US 7,766,318 B2
(45) Date of Patent: Aug. 3, 2010

(54) PICKOFF MECHANISM FOR MAIL FEEDER

(75) Inventors: Simon Jan Krause, Constance (DE); Rajeev Dwivedi, Plano, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 12/186,108

(22) Filed: Aug. 5, 2008

(65) Prior Publication Data

US 2010/0032889 A1 Feb. 11, 2010

(51) Int. Cl.
*B65H 5/08* (2006.01)

(52) U.S. Cl. ..... 271/12; 271/11; 271/14

(58) Field of Classification Search ..... 271/11, 271/12, 149, 14
See application file for complete search history.

(56) References Cited

U.S. PATENT DOCUMENTS 3,599,967 A * 8/1971 Rapperlie et al. ..... 271/12
3,649,002 A * 3/1972 Burkhardt ..... 271/96
3,995,851 A 12/1976 Casper
4,030,723 A * 6/1977 Irvine et al. ..... 271/11
4,235,432 A * 11/1980 Marschke ..... 271/11
4,382,593 A * 5/1983 Beran et al. ..... 271/12
4,541,624 A * 9/1985 Sasage et al. ..... 271/12
4,621,798 A 11/1986 Akers
4,701,094 A * 10/1987 Courjaret et al. ..... 271/11
5,074,539 A * 12/1991 Wells et al. ..... 271/12
5,109,987 A 5/1992 Daboub et al.
5,398,922 A 3/1995 Malatesta
5,478,066 A * 12/1995 Yoshida et al. ..... 271/12
6,607,193 B2 * 8/2003 Nordling et al. ..... 271/99
6,679,491 B2 1/2004 Luebben et al.
7,007,940 B2 * 3/2006 Polidoro et al. ..... 271/3.11
7,007,942 B1 * 3/2006 Stearns et al. ..... 271/11
2002/0011703 A1 * 1/2002 Tomiyama et al. ..... 271/12
2003/0015835 A1 * 1/2003 Post et al. ..... 271/149
2003/0038065 A1 2/2003 Pippin et al.

* cited by examiner

*Primary Examiner*—Patrick Mackey
*Assistant Examiner*—Prasad V Gokhale

(57) ABSTRACT

A pickoff system for removal of mail pieces one at a time from the end of a stack includes a pickoff belt mechanism positioned to frictionally engage an outer surface of a mail piece at the end of the stack and transport it transversely, which mechanism includes one or more belts mounted on a drive roller at one end driven by a drive motor and a follower roller at a trailing end. A pivot mechanism permits the trailing end to swing towards and away from the stack. A drive is connected to the pivot mechanism to move the trailing end towards and away from the stack, and a controller is connected to the drive to cause the drive to swing the trailing end towards the stack and swing the trailing end away from the stack in a manner effective to improve operation of the pickoff system.

6 Claims, 6 Drawing Sheets

PICKOFF MECHANISM FOR MAIL FEEDER

TECHNICAL FIELD

The invention relates to feeding systems for automated mail sorting machines, in particular to an improved pickoff mechanism for a mail feeder.

BACKGROUND OF THE INVENTION

Pickoff mechanisms have been in use for decades in automated letter sorting machines such as MLOCR and DBCS machines used by the U.S. Postal Service and private presort bureaus, as described, for example, in U.S. Pat. Nos. 5,109,987 (Daboub) and 6,679,491 (Luebben et al). The feeder section of the machine includes an unloading table where mail for sorting is manually placed edgewise to form a stack. The stack is advanced incrementally towards the pickoff mechanism which functions to feed mail pieces one at a time into a pinch belt conveyor system for sorting.

Known pickoff mechanisms comprise a series of rubber belts wound over a drive roller and a follower roller. The belts engage the endmost mail piece of the stack and rely on friction to pull it sideways off of the stack and into the entry nip of the pinch belt conveyor. Friction is created by the pressure of the mail stack as it advances into contact with the pickoff belts. The stack is carried by a horizontal belt conveyor, and its remote end is supported by a paddle movably mounted on a frame of the feeder. The paddle and belt are synchronized to move the stack forward in increments. This is controlled by a letter present sensor, for example, a mechanical proximity switch using a spring arm which indicates to the feeder controller that the end of the stack is in engagement with the outer face of the pickoff belts.

Some known pickoff designs rely on keeping the stack under pressure against the pickoff belts to create sufficient friction so that the pickoff operation proceeds smoothly at high speed. In one such known device as shown in FIG. 4, the trailing end 91 of the pickoff 90 is capable of swinging back in the direction of the arrow. A spring 92 becomes compressed when stack pressure exceeds a threshold level, and returns pickoff 90 to its starting position when the pressure is relieved. However, this type of passive pivoting mechanism does not swing out beyond its starting position shown and is not effective to improve pickoff speed and reliability to an optimum extent.

In practice, mail pieces are not uniform and sometimes slip against the pickoff belts, delaying feeding of the mail piece to the pinch belts. To remedy this, vacuum-assisted pickoff mechanisms were devised wherein suction is applied to the endmost mail piece through holes in the belts. This prevents slipping of mail pieces to a greater extent, but not entirely. The problem becomes more difficult when the incoming mail in the stack includes mail pieces of different sizes and thicknesses, such that some require more frictional force to feed than others. Present pickoff mechanisms have no means of adjusting to compensate for variations in mail piece characteristics. The present invention seeks to remedy this limitation, and in so doing improved performance of the conveyor as a whole by improving throughput.

SUMMARY OF THE INVENTION

The invention provides a pickoff system for removal of mail pieces one at a time from the end of a stack. A pickoff belt mechanism is positioned to frictionally engage an outer surface of a first piece at the end of the stack and transport it transversely to a thickness direction of the stack, which mechanism includes one or more belts mounted on a drive roller at one end driven by a drive motor and a follower roller at a trailing end. A pivot mechanism permits the trailing end to swing towards and away from the stack. A drive is connected to the pivot mechanism to move the trailing end towards and away from the stack, and a controller is connected to the drive to cause the drive to swing the trailing end towards the stack and swing the trailing end away from the stack in a manner effective to improve operation of the pickoff system, i.e., improve both pickoff speed and reliability.

According to one embodiment, a sensor connected to the controller measures pressure exerted by the stack against the pickoff belt mechanism, and the controller is connected to the drive to cause the drive to swing the trailing end towards the stack in response to a decrease in stack pressure, and swing the trailing end away from the stack in response to an increase in stack pressure. In another embodiment, the drive is operated based on a sensor that detects when the first mail piece has moved far enough that a second mail piece behind the first mail piece on the stack can come into contact with the trailing end of the pickoff belt mechanism. The controller causes the drive to swing the trailing end out towards the stack when the sensor indicates the first mail piece has moved far enough that a second mail piece behind the first mail piece on the stack can come into contact with the trailing end of the pickoff belt mechanism. Thereafter it causes the drive to swing the trailing end away from the stack. This event can be based on a timer, or on a further reading from the sensor.

The invention further provides a method for removal of mail pieces one at a time from the end of a stack supported edgewise on a base belt conveyor. Such a method includes a step of advancing the base belt conveyor to bring an endmost mail piece into contact with the a pickoff belt mechanism. The outer surface of the mail piece at the end of the stack is frictionally engaged with the pickoff belt mechanism which includes one or more belts mounted on a drive roller at one end driven by a drive motor and a follower roller at a trailing end, thereby transporting the mail piece transversely to a thickness direction of the stack. The trailing end of the pickoff belt mechanism swings cyclically towards the stack in a manner effective to improve operation of the pickoff belt mechanism by engaging a second mail piece at the end of the stack sooner than by operation of the base belt conveyor alone following removal of the first mail piece, and then swings away from the stack in preparation for pickoff of the next mail piece in the stack.

In a mail processing environment, the stack is typically supported edgewise on a conveyor base belt that advances as needed to bring an endmost (front) mail piece into contact with the belt of the pickoff belt mechanism. The foregoing method is especially useful when the stack contains mail pieces of varying sizes, especially thicknesses. After pickoff, each mail piece is fed directly from the pickoff belt mechanism to a pinch belt conveyor such as is used in a postal sorting machine. The present invention makes it possible to run the base belt conveyor at a constant speed rather than intermittently. These and other aspects of the invention are discussed further in the detailed description that follows.

BRIEF DESCRIPTION OF THE DRAWINGS

In the accompanying drawings, wherein like numerals denote like elements.

DETAILED DESCRIPTION

Figure 1:
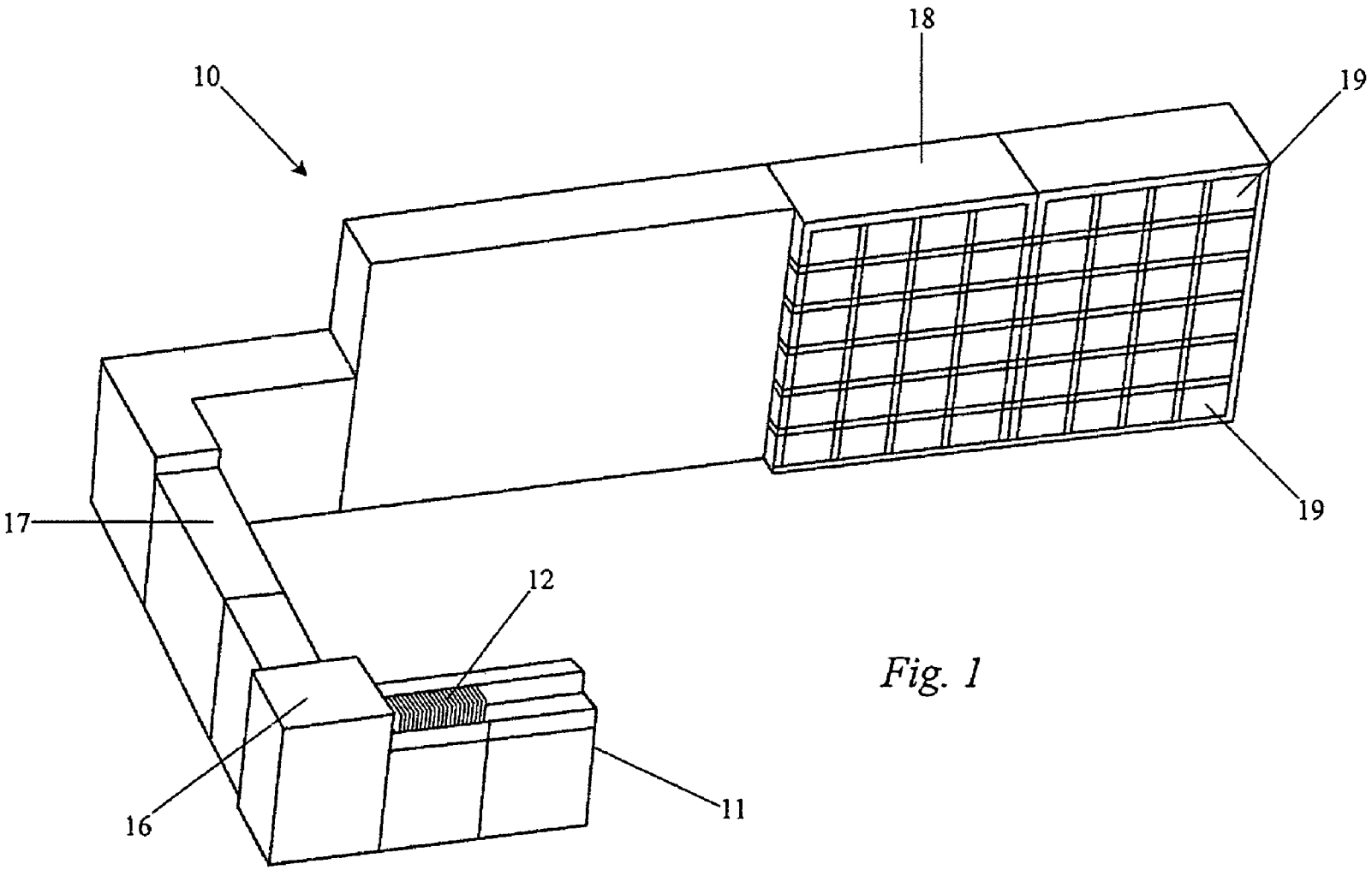
FIG. 1 is a perspective view of a mail sorting machine according to the invention.

Referring to FIG. 1, a mail sorting machine 10 such as a DBCS or MLOCR includes a mail feeder 11 upon which a stack 12 of unsorted mail pieces 13 are loaded for processing. Feeder 11 advances the stack 12 to a pickoff apparatus 16 that feeds a singulated stream of individual mail pieces through a transport section 17 to an automated sorting section or stacker 18 which sorts the mail in one or more passes to a plurality of bins or pockets 19. In transport section 17, each mail piece 13 is scanned for address information. For purposes of the invention, a "mail piece" is a letter, postcard or flat of a type that is commonly fed from the end of a stack one piece at a time into a sorting or other postal processing machine.

Throughput in a mail sorter 10 is a function both of belt speed and maintaining consistent gap spacing between mail pieces moving on the pinch belt conveyor system. Consistent gap spacing between successive mail pieces improves throughput while maintaining the same belt speed, for example 4m/sec. However, where mail pieces 13 vary in thickness, it can be difficult for the base belt which presents the end of the stack 12 to the pickoff maintain a consistent stack pressure. Feeder 11 according to the invention includes an actively-controlled, variable position pickoff mechanism 20 as described hereafter that can respond to variations in mail piece thickness so that unusually thick mail pieces can be fed into the sorter with less delay and more consistent spacing.

Figure 2:
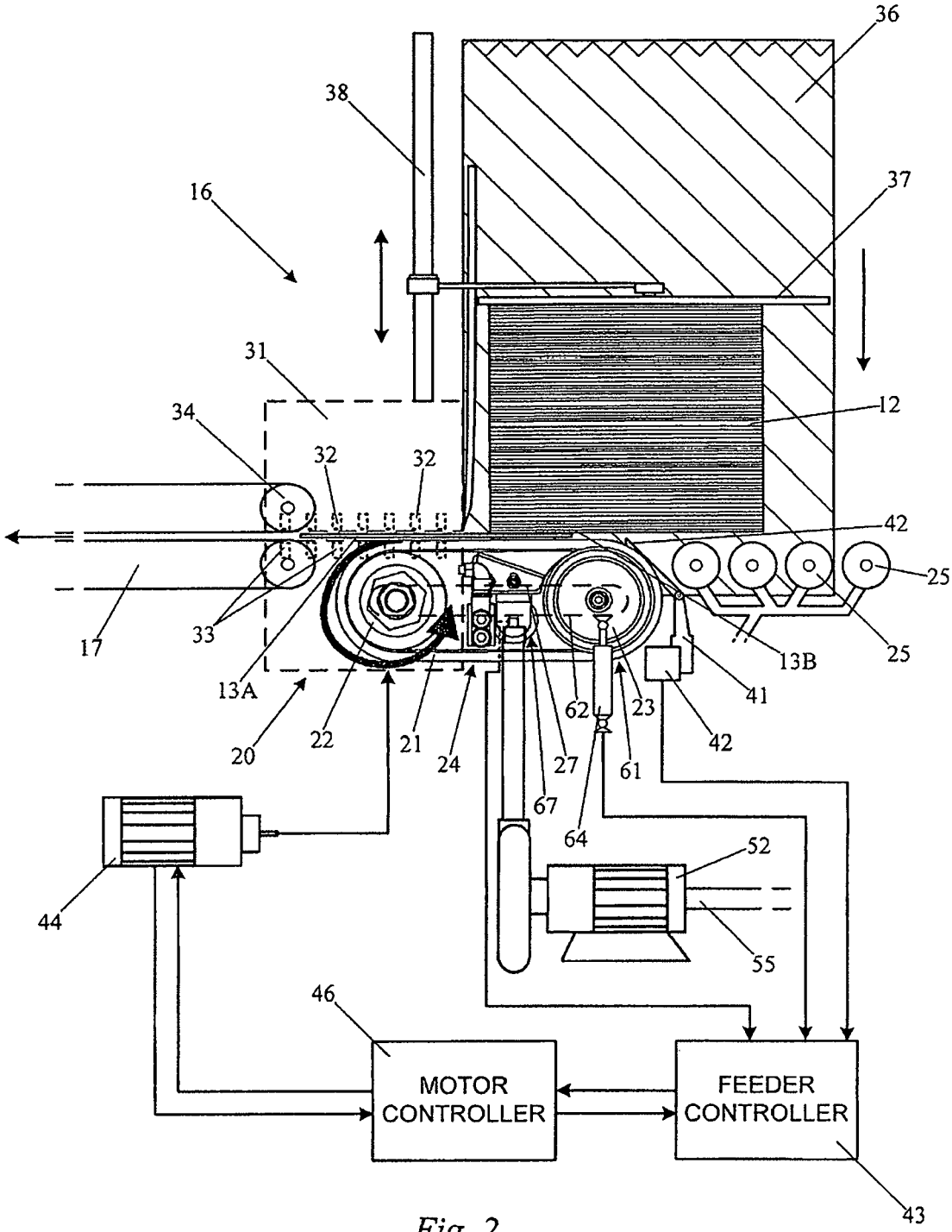
FIG. 2 is a schematic top view of a pickoff system used in the machine of FIG. 1.
Figure 3:
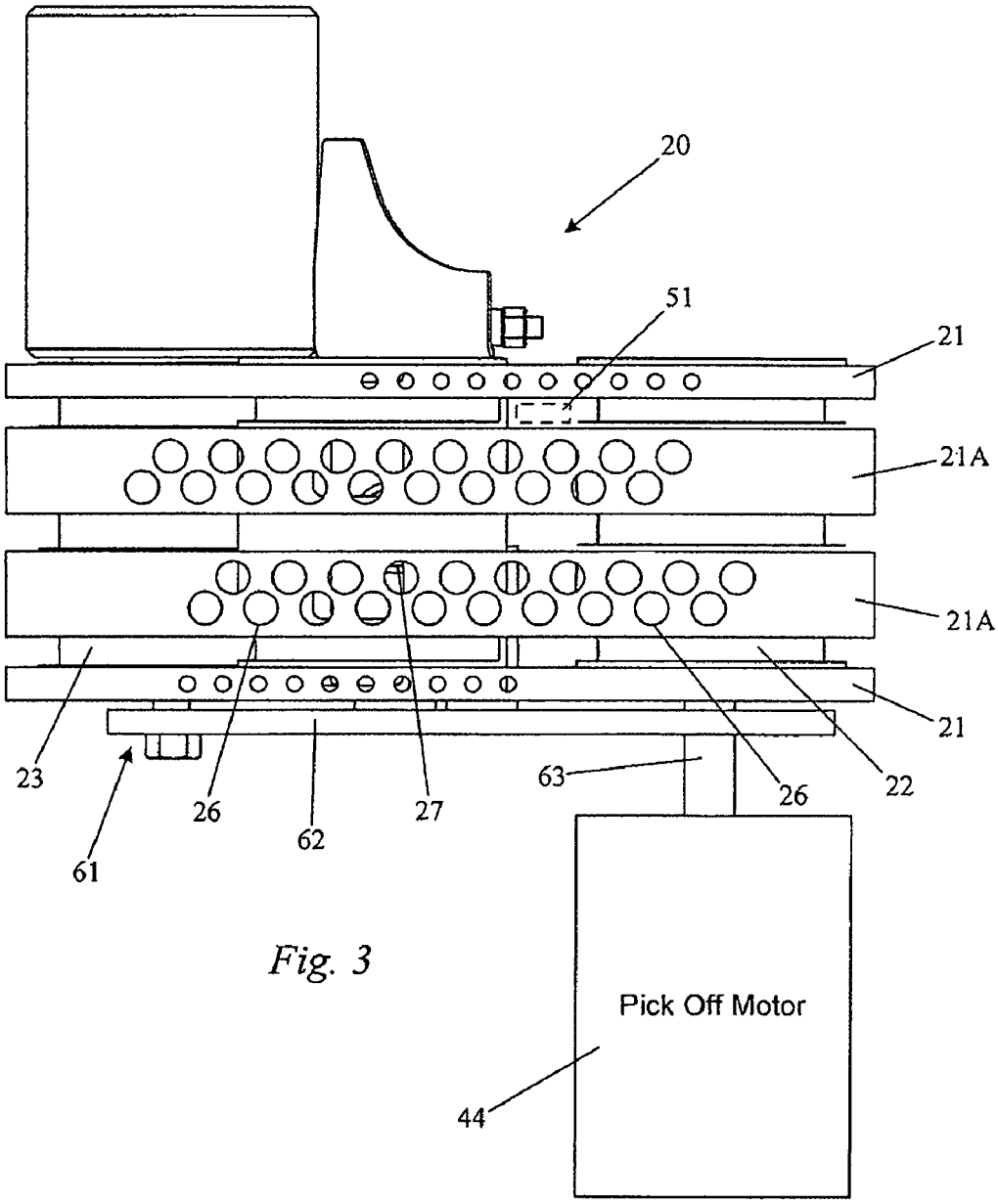
FIG. 3 is a front view of the pickoff belt shown in FIG. 2.
Figure 4:
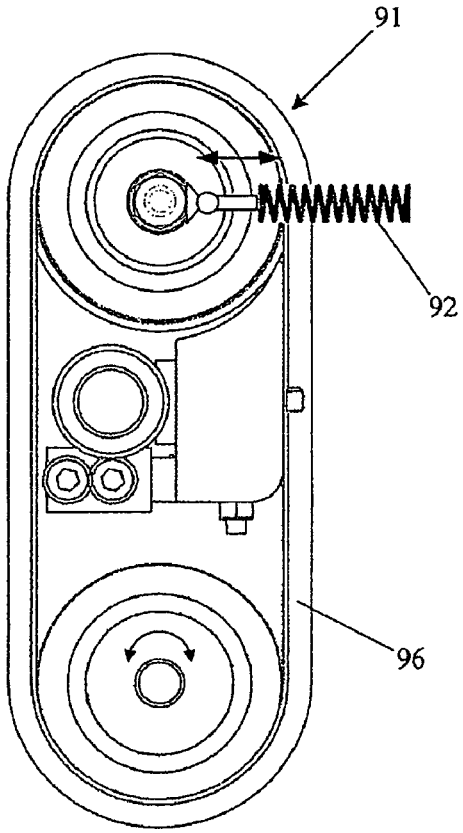
FIG. 4 is a top view of a prior art pickoff belt.
Figure 5:
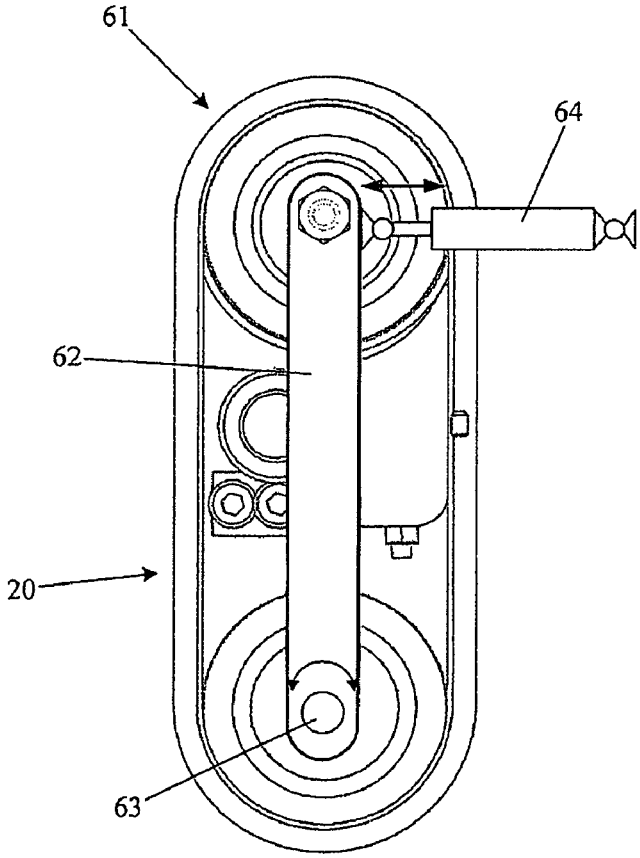
FIG. 5 is a top view of a pickoff belt according to the invention.

Referring to FIGS. 2-4, a vacuum pickoff 20 for use in sorter 10 has a set of vertically spaced rubber belts 21 wound over a drive roller 22 and a follower roller 23 to provide a generally racetrack-shaped pickoff belt mechanism 24. At least the middle belts 21A of the set have spaced holes 26 therethrough. A vacuum chamber 27 is presented inside the mechanism 24 between rollers 22, 23 and positioned so that suction is applied through middle belts 21A as they pass chamber 27, which suction is applied through holes 26 to a mail piece 13A at the leading end of the stack 12 to be sorted. Vacuum chamber 27 is connected to a vacuum pump 52. Pump 52 draws air through an intake line 55.

A set of vertical guide rollers 25 rollingly support the right side of stack 12 which overhangs the end of pickoff belt mechanism 24 as shown in FIG. 2. A light array sensor 31 includes a horizontal row of emitters 32 and a row of receivers 33 aligned with each emitter 32. Light array sensor 31 is positioned on opposite sides of the pickoff path bridging the transition shown between the pickoff belt mechanism 24 and takeaway pinch belt mechanism 34. Mail pieces 13 once engaged by the pinch belts are carried through transport section 17. The imaging camera used to read the bar code and/or printed address on each mail piece is just downstream from pickoff 20. Light array sensor 31 is conventionally used to control the pickoff process by detecting the leading and trailing edges of mail pieces removed from stack 12. However, the feeder 11 according to the present invention could be controlled based on measurements of pressure in the vacuum chamber as described further below.

The stack of mail 12 is positioned on a horizontal carrier conveyor belt (or base belt) 36. The trailing end of the stack 12 is supported by a paddle 37 that is moved along a guide bar 38 in a manner known in the art to support the stack. The leading end of the stack 12 advances into contact with a pivoting arm mechanism 41 which, when actuated, triggers a contact switch (sensor) 42 that indicates to a system controller 43 that mail is in position for pickoff. Pivoting arm 41 and switch 42 are one form of letter present sensor that could be used.

Drive roller 22 of pickoff belt mechanism 24 is driven by an encoder-equipped electric motor 44. Motor 44 sends a signal to a motor controller 46 indicating the motor speed in revolutions (rpm). Controller 46 relays the signal to feeder controller 43. The encoder is not essential to the present invention, but the belt speed can be used by the controller 43 as an indicator of mail piece slipping such that it will increase the stack pressure temporarily as described below to increase the friction between the mail piece and pickoff mechanism 24.

A trailing end 61 of the pickoff belt mechanism 24 is capable of swinging forward and back in the direction of the mail stack 12. For this purpose, an elongated bar 62 is pivotally mounted at one end on the drive shaft 63 of drive motor 44, and is connected at its other end to trailing end 61 and to the actuator of a linear drive 64. Linear drive 64 is operated by feeder controller 43 and the load on linear drive 64 indicates the stack pressure and is monitored by controller 43. This aspect of the invention can operate based on a simple feedback loop wherein a decrease in stack pressure, such as occurs when the leading mail piece 13A is removed, causes the actuator of linear drive 64 to extend and trailing end 61 to swing out, and an increase in stack pressure causes linear drive 64 to retract so that trailing end 61 swings in. The range of movement of trailing end 61 preferably varies from a rearwardmost starting position wherein trailing end 61 is perpendicular to the direction of travel of the base belt 36 and a number of extended positions wherein trailing end 61 is at an angle of slightly greater than 90° relative to the direction of travel of base belt 36. "Slightly" in this case refers to angles of the magnitudes shown in FIGS. 6A-6D, for example, defining a range of movement from 90 to 100 degrees, especially about 90-95° between the axis of (shaft 63) and the direction of travel of the base belt 36. Trailing end 61 does not need to pivot back beyond the 90° position shown in FIG. 6A.

Figure 6A:
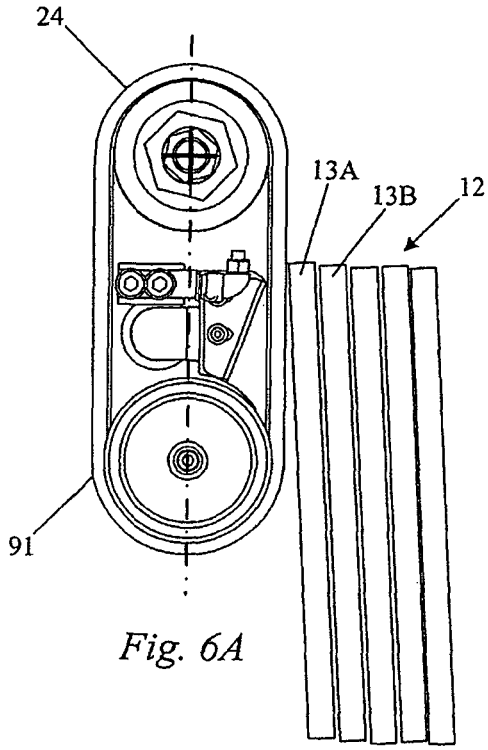
FIGS. 6A to 6D are a series of top views of the pickoff belt of FIG. 5 in use.
Figure 6B:
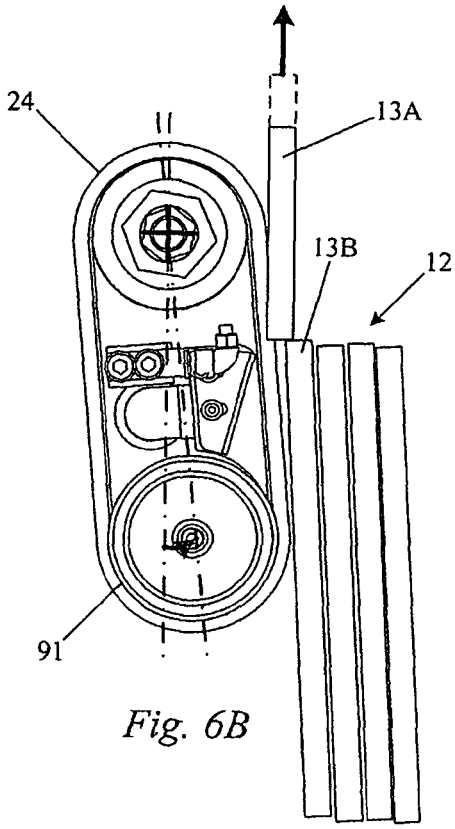
Figure 6C:
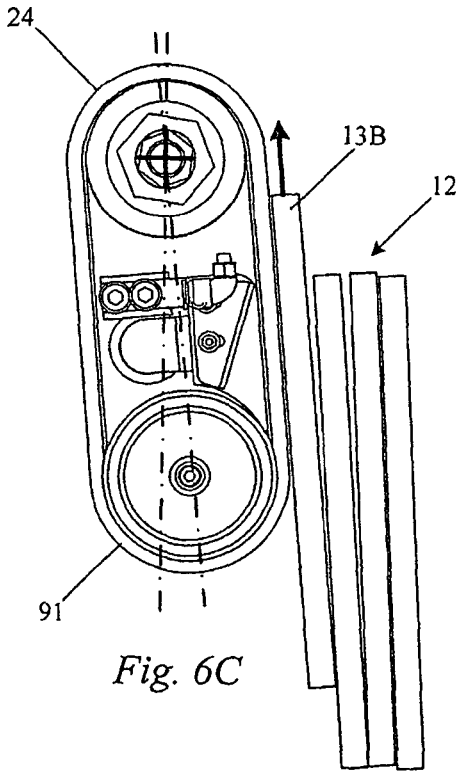

In one example of operation, the mail-pieces 13 start lying at the pickoff belts 21 as shown in FIG. 6A. Using the load on the linear drive 64, the stack-pressure is measured. When the first mail-piece 13A accelerates, it passes the vacuum chamber 27. The pressure in vacuum chamber 27 is monitored using a pressure sensor 67. Before the trailing edge of mail piece 13A breaks the vacuum seal, linear drive 64 extends and the trailing end 61 of the pickoff belt mechanism 24 starts to move towards the next mail piece 13B (FIG. 6B). This event can be triggered using the stack pressure measurement (from linear drive 64), from the level of vacuum in vacuum chamber 27, or by a pair of laser distance sensors. These laser distance sensors are conventionally used to detect the distance between successive mail pieces and could perform an additional function in the present invention of triggering the extension of linear drive 64 based on the distance between mail pieces 13A and 13B. In a preferred embodiment, the extent of the change in stack pressure detected from linear drive 64 determines the extent to which trailing end 91 will swing out into contact with mail piece 13B as shown in FIG. 6B.

Figure 8:
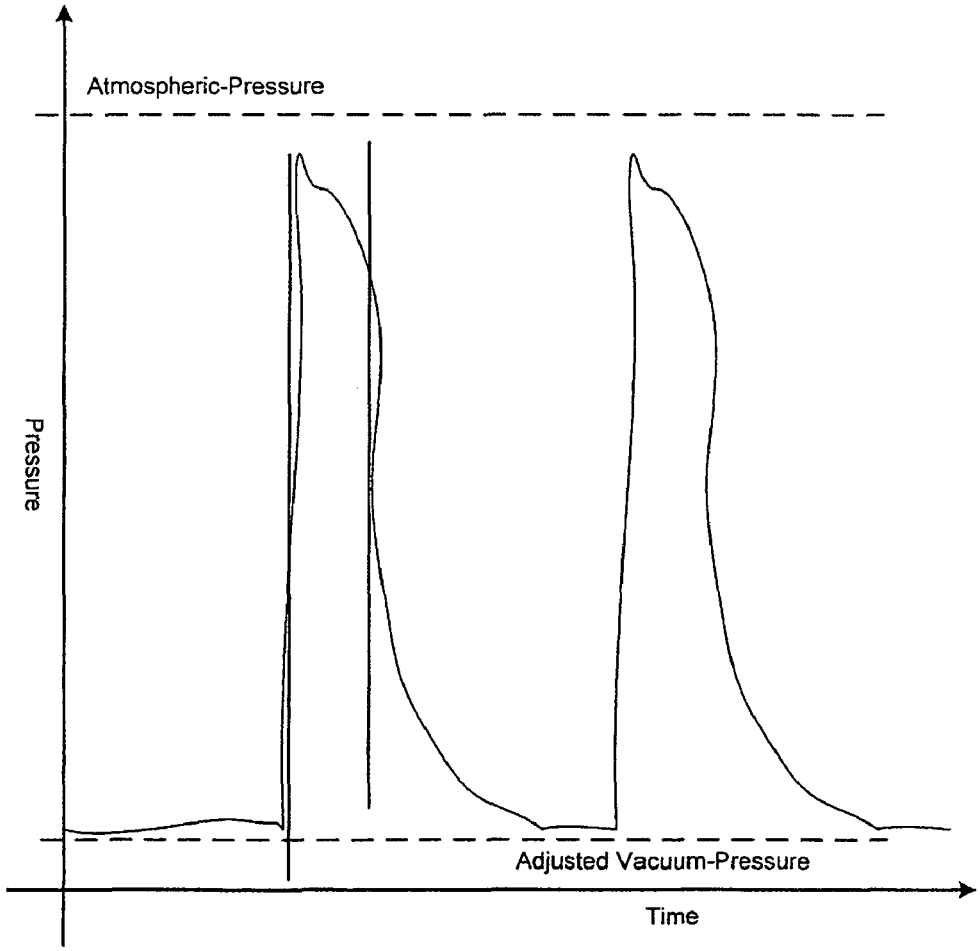
FIG. 8 is a graph of vacuum pressure versus time during a pickoff operation according to the invention.

As mail piece 13A continues to move, its trailing edge will be detected by the progressive uncovering of the rightmost sets of photocell pairs 32, 33 shown in FIG. 2, if present. The next mail piece 13B engages pickoff belt mechanism 24 and the cycle starts again as a signal from switch 42 indicates that the next mail piece 13B is ready for pickoff. However, if no light array sensor 31 is provided, then the pickoff cycle can be controlled by means of pressure sensor 67, which measures changes in pressure in vacuum chamber 27 as shown in FIG. 8. These changes indicate when a mail piece 13 is or is not covering the holes 26 in belts 21 that seal off vacuum chamber 27, and thereby it can be determined that mail piece 13A has moved off of pickoff belt mechanism 24.

Figure 6D:
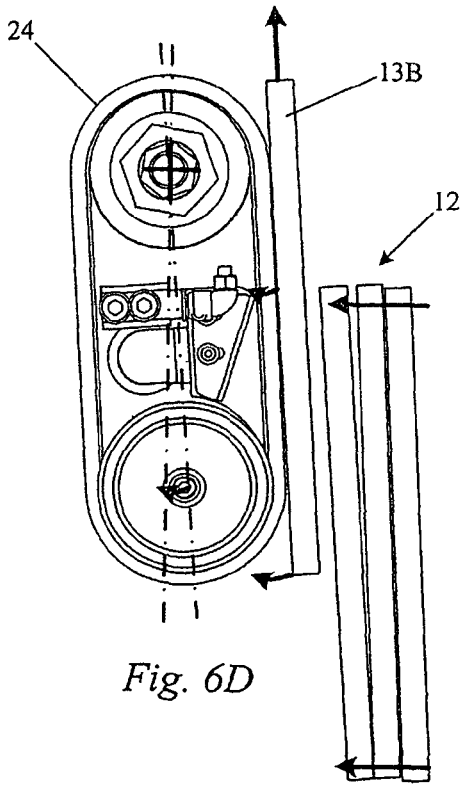

When the pickoff reaches a predetermined normal stack pressure and vacuum is generated against mail piece 13B (FIG. 6C), the trailing end 61 of the pickoff belt mechanism 24 swings inward by retraction of linear drive 64 during the acceleration of the mail-piece 13B as shown in FIG. 6D. The base belt 36 also moves and follows the movement of the pickoff belt mechanism 24.

For thin mail-pieces 13, it is easier to react to a changing vacuum pressure with the pickoff belt mechanism 24 than to detect the trailing edge and the thickness of the mail piece 13A. The light array 31 will detect all mail pieces 13, but laser distance sensors cannot detect every trailing edge of thin mail pieces. The combination is important; with the combination of signals from pressure sensor 67 and light array 31, controller 43 can determine that a mail piece which has a thickness that not detectable with laser distance sensors was fed to the takeaway conveyor 34. Also, by the foregoing means, the stack pressure can be kept constant easier and faster than in the conventional way. With the system of the invention, it is possible to actively reduce the stack-pressure when increased stack pressure has been detected by moving the pickoff mechanism 24 away from the stack 12.

For thick mail pieces 13, the base belt 36 does not need to accelerate the whole stack 12 in order for pickoff to proceed. The pickoff plane (parallel to the dotted lines in FIGS. 6A-6D) will move towards the stack 12. It is faster to move the lighter pickoff mechanism 24 inclusive of the vacuum chamber 27 so that the gap between the pickoff mechanism 24 and the second mail piece 13B can be closed faster than in the existing way. The base belt 36 can be kept in continuous movement without starting and stopping.

Figure 7:
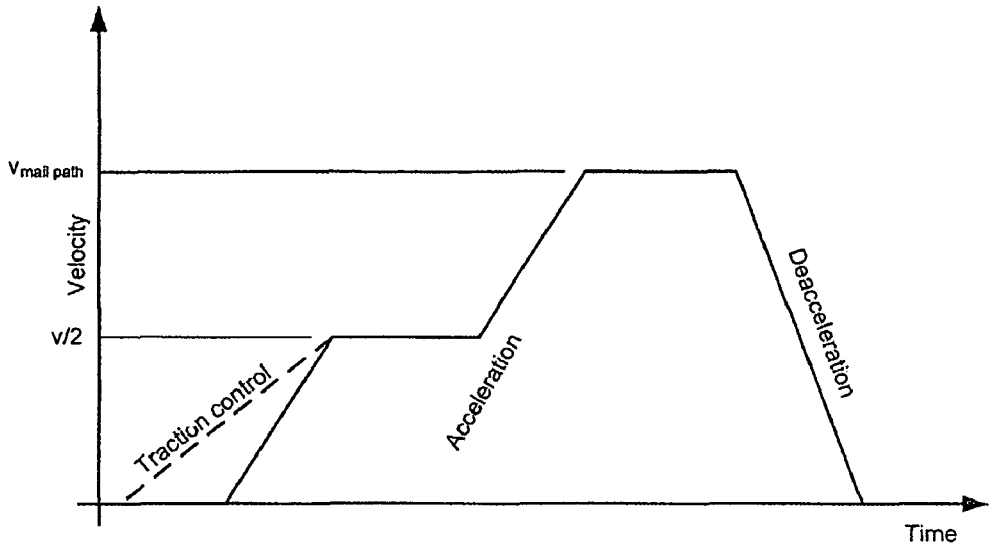
FIG. 7 is a graph of mail piece velocity versus time during a pickoff operation according to the invention.

The actively controlled, variable position pickoff system of the invention is used to reduce mail stack acceleration, increase pickoff rate, make earlier contact with the next mail piece, control the gap between pickoff plane and the next sequential mail piece 13 without moving the whole stack 12, measure stack-pressure at the pickoff 24, and control the stack pressure. The compressibility and inertia of the mail stack 12 causes a spring-like motion when force is applied to it by the base belt 36. The spring-like motion forces the mail to tilt backwards and forwards. This motion creates a gap between the pickoff plane and the leading letter in the stack. As illustrated in FIG. 7, the variable position pickoff plane according to the invention reduces the acceleration ramp and/or the top-speed of the base belt 36. In other words, the distance between the pickoff plane and the next mail piece has to be closed. The conventional feeder can only move the base belt to accomplish this. The movable pickoff system of the invention can move the pickoff and the base belt at the same time. This means speed and acceleration ramp of the pickoff can be subtracted from the acceleration ramp and speed of the base belt. As a result, the entire stack does not have to accelerated as fast. Using the movable pickoff of the invention, the stack stays quieter and more stable.

The dotted line on the acceleration side represents traction control in the form a temporary decrease in belt speed which can occur as a result of slipping correction measures, for example, a temporary slowdown of the pickoff belt by the action of controllers 43, 46 when it has been determined that the mail piece is moving slower than the belt. The variable position pickoff plane also presents the leading end of the stack to the pickoff mechanism 24 in a uniform manner. Uniform presentation will create more ideal vacuum pickoff for sequential mail pieces. For purposes of the invention, the pickoff plane is the flat surface of the belts 21 that engage each mail piece 13 as it is presented. The pickoff plane is parallel to and spaced from the lengthwise axis of pickoff mechanism 24 represented by dotted lines in FIGS. 6A-6D.

FIG. 8 illustrates operation of the vacuum chamber 27 in a process according to the invention. The trailing edge of the mail piece 13A passes the vacuum chamber 27 and uncovers it, causing the pressure to drop from near atmospheric (upper dotted line) to or near a baseline level (lower dotted line). Then the next mail piece 13B seals off the vacuum chamber 27 and the pressure rapidly increases to its maximum. This cycle should repeat as uniformly as possible during operation. The sudden drop in vacuum pressure showing that mail piece 13A has moved on as shown in FIG. 6B can be used to start pickoff of mail piece 13B.

Although one embodiment of the present invention have been described in the foregoing detailed description and illustrated in the accompanying drawings, it will be understood by those skilled in the art that the invention is not limited to the embodiment disclosed but is capable of numerous rearrangements, substitutions and modifications without departing from the spirit of the invention. A controller for purposes of the invention may be a single control unit that operates the various components or two or more controllers that work together as described above. Similarly a "sensor" could be a single sensor, or two or more sensors from which the outputs enable the controller to make a decision based on preprogrammed criteria. These and other modifications are within the scope of the invention as expressed in the appended claims.

The invention claimed is:

1. A pickoff system for removal of mail pieces one at a time from the end of a stack of mail pieces supported edgewise in face to face contact with one another, comprising:

a pickoff belt mechanism positioned to frictionally engage an outer surface of a first mail piece at the end of the stack and transport it in a pickoff direction transversely to a thickness direction of the stack towards a leading end of the belt mechanism and away from a trailing end of the belt mechanism, which mechanism includes one or more belts mounted on a drive roller at the leading end driven by a drive motor and a follower roller at ((a)) the trailing end;

a pivot mechanism by which the trailing end can swing towards and away from the stack;

a drive connected to the pivot mechanism to move the trailing end towards and away from the stack; and a controller connected to the drive to cause the drive to swing the trailing end towards the stack and swing the trailing end away from the stack in a manner effective to improve operating speed of the pickoff system, further comprising means for measuring pressure exerted by the stack against the pickoff belt mechanism, and the controller is connected to the drive to cause the drive to swing the trailing end towards the stack in response to a decrease in stack pressure, and swing the trailing end away from the stack in response to an increase in stack pressure.

2. The apparatus of claim 1, wherein the measuring means measures load on the drive.

3. A pickoff system for removal of mail pieces one at a time from the end of a stack, comprising:

a pickoff belt mechanism positioned to frictionally engage an outer surface of a first mail piece at the end of the stack and transport it transversely to a thickness direction of the stack towards a leading end of the belt mechanism and away from a trailing end of the belt mechanism, which mechanism includes one or more belts mounted on a drive roller at one end driven by a drive motor and a follower roller at a trailing end;

a pivot mechanism by which the trailing end can swing towards and away from the stack;

a drive connected to the pivot mechanism to move the trailing end towards and away from the stack; and a controller connected to the drive to cause the drive to swing the trailing end towards the stack and swing the trailing end away from the stack in a manner effective to improve operating speed of the pickoff system, wherein the drive is a linear drive including an extendible, retractable actuator that is pivotally connected to the trailing end of the pickoff belt mechanism, and the pivot mechanism includes a bar pivotally mounted at one end on an axis of rotation of the drive roller and pivotally mounted at its other end to the trailing end of the pickoff belt mechanism, whereby pivoting of the bar about the axis of rotation of the drive roller occurs when the trailing end swings towards and away from the stack.

4. The apparatus of claim 3, wherein the bar is disposed beneath the pickoff belt mechanism and extends in parallel to a pickoff plane defined by the belts of the pickoff belt mechanism which contact mail pieces.

5. The apparatus of claim 4, wherein the bar and the actuator of the linear drive are each pivotally mounted to an axis of the follower roller.

6. A method for removal of mail pieces one at a time from the end of a stack supported edgewise on a base belt conveyor, comprising:

advancing the base belt conveyor to bring an endmost mail piece into contact with the a pickoff belt mechanism;

frictionally engaging the outer surface of the mail piece at the end of the stack with the pickoff belt mechanism, which includes one or more belts mounted on a drive roller at one end driven by a drive motor and a follower roller at a trailing end, thereby transporting the mail piece transversely to a thickness direction of the stack;

cyclically swinging the trailing end towards the stack in a manner effective to improve operation of the pickoff belt mechanism by engaging a second mail piece at the end of the stack sooner than by operation of the base belt conveyor alone following removal of the first mail piece, and then swinging the trailing end of the stack away from the stack, further comprising running the base belt conveyor at a constant speed as the cyclical swinging of the trailing end occurs.

* * * * *